US011073271B1

(12) United States Patent
Huang

(10) Patent No.: US 11,073,271 B1
(45) Date of Patent: Jul. 27, 2021

(54) LIGHT FIXTURE

(71) Applicant: APUTURE IMAGING INDUSTRIES CO., LTD., Shenzhen (CN)

(72) Inventor: Chongbo Huang, Shenzhen (CN)

(73) Assignee: APUTURE IMAGING INDUSTRIES CO., LTD., Shenzhen (CN)

( * ) Notice: Subject to any disclaimer, the term of this patent is extended or adjusted under 35 U.S.C. 154(b) by 0 days.

(21) Appl. No.: 17/128,863

(22) Filed: Dec. 21, 2020

(30) Foreign Application Priority Data

Sep. 30, 2020 (CN) ..... 202022221632.4

(51) Int. Cl.
*F21V 29/76* (2015.01)
*F21V 17/06* (2006.01)
*F21V 31/00* (2006.01)

(52) U.S. Cl.
CPC ..... *F21V 29/76* (2015.01); *F21V 17/06* (2013.01); *F21V 31/005* (2013.01)

(58) Field of Classification Search
CPC ..... F21V 29/76; F21V 17/06; F21V 31/005
See application file for complete search history.

(56) References Cited

U.S. PATENT DOCUMENTS

2010/0309662 A1* 12/2010 Zheng ..... F21V 1/02 362/235

* cited by examiner

*Primary Examiner* — Thomas M Sember
(74) *Attorney, Agent, or Firm* — The Roy Gross Law Firm, LLC; Roy Gross

(57) ABSTRACT

A light fixture includes a housing with a hollow inner cavity, and a first ventilation region and a second ventilation region are arranged on the housing; a heat sink disposed in the hollow inner cavity of the housing, wherein the heat sink includes a plurality of fins disposed side-by-side corresponding to the first ventilation region and the second ventilation region; and a blocking mechanism disposed between the heat sink and an inner wall of the housing to divide the hollow inner cavity into a first cavity and a second cavity. The plurality of fins are disposed in the first cavity, the first cavity and the second cavity are isolated from each other. A gap is formed between any two adjacent fins, and the first ventilation region the gap and the second ventilation region are communicating to form a channel. The light fixture has good heat dissipation and waterproof effects.

12 Claims, 8 Drawing Sheets

LIGHT FIXTURE

PRIORITY CLAIM

This application claims priority to Chinese Patent Application Number 202022221632.4 filed Sep. 30, 2020, the disclosures of which are incorporated in their entirety by reference herein.

FIELD OF INVENTION

The present disclosure relates to the field of lighting technology, specifically relates to a light fixture.

BACKGROUND OF INVENTION

In all areas of work and life, lighting needs are very important. Light fixtures used for lighting usually include all the parts needed to fix and protect the light source except the light source, as well as the wiring accessories are necessary for connecting with the power source.

According to different application scenarios, the specific structure and shape of the light fixture are also different. For example, in addition to the conventional power supply structure, household light fixtures include light fixture tubes, and the outer cover of the light fixture tubes, etc. But in light-emitting diodes (Light Emitting Diode, LED), workplace light fixtures and TV lighting fixtures, in addition to the above structures, heat-dissipation structures are also disposed to guide the large amount of heat emitted by the light-emitting element in the working state to avoid damage to the light fixture.

Regardless of occasion the light fixtures used in, the lighting equipment must work stably and reliably. The light fixtures are required to have good heat dissipation and waterproof functions to ensure the normal working state of the light-emitting elements. Especially for complex application scenarios, the waterproof requirements of light fixtures are higher.

SUMMARY OF INVENTION

The present disclosure provides a light fixture in order to at least partially solve the technical problems of poor heat dissipation and waterproof performance of light fixtures in prior arts.

The present disclosure provides a light fixture comprising: a housing with a hollow inner cavity, wherein a first ventilation region and a second ventilation region are arranged on the housing;

a heat sink disposed in the hollow inner cavity of the housing, wherein the heat sink includes a plurality of fins disposed side-by-side corresponding to the first ventilation region and the second ventilation region; and a blocking mechanism disposed between the heat sink and an inner wall of the housing to divide the hollow inner cavity into a first cavity and a second cavity, wherein the plurality of fins are disposed in the first cavity, the first cavity and the second cavity are isolated from each other;

wherein a gap is formed between any two adjacent fins, and the first ventilation region the gap and the second ventilation region are communicating to form a channel.

In some embodiments, the first ventilation region, the heat sink and the second ventilation region are arranged in a first direction, the first cavity and the second cavity are isolated by the blocking mechanism in a second direction, and the first direction and the second direction intersect on the same plane.

In some embodiments, the light fixture further comprises a air-cooling structure fixed in the housing, wherein the air-cooling structure is disposed between the heat sink and the second ventilation region, and the air outlet surface of the air-cooling structure faces one side of the heat sink.

In some embodiments, the light fixture further comprises:

a light source protecting assembly which has a hollow cavity, wherein the light source protecting assembly is fixedly attached to the housing;

a light source part thermally connected to the heat sink, wherein the light source part is disposed in the hollow cavity of the light source protecting assembly; and a circuit board electrically connected to the light source part, and the circuit board is disposed in the second cavity.

In some embodiments, the blocking mechanism comprises a first rib disposed in the housing, a groove is disposed on an inner side wall of the housing, at least the upper outer peripheral portion of the first rib is engaged in the groove, the first rib and the inner wall of the housing enclose to form the second cavity, the first ventilation region and the second ventilation region are located outside the second cavity, and the circuit board is thermally connected to the heat sink and disposed in the second cavity.

In some embodiments, the blocking mechanism comprises a first rib disposed in the housing and a second rib fixed to the inner side wall of the housing, at least the second rib extends from the top of the inner side wall of the housing to the hollow inner cavity of the housing, the second rib is closed to the first rib and at least partly overlap with each other, wherein the first rib, the second rib and the inner wall of the housing encloses to form the second cavity, the first ventilation region and the second ventilation region are located outside the second cavity, and the circuit board is thermally connected to the heat sink and disposed in the second cavity.

In some embodiments, the blocking mechanism comprises a third rib disposed in the housing, at least the upper outer peripheral portion of the third rib sealing fitting with the housing, the third rib and the inner wall of the housing enclose to form a third cavity, the first ventilation region and the second ventilation region are located outside the third cavity, and wherein the third cavity is communicating with the hollow cavity of the light source protecting assembly.

In some embodiments, the light source protecting assembly comprises a sleeve with a hollow cavity, a first gasket, and a first cover unit with a first light-transmitting part; wherein the light source part is sleeved in the hollow cavity of the sleeve, the first cover unit presses the first gasket onto one end of the sleeve, and wherein the first cover unit is fixed on the sleeve the other end of which is fixedly attached to the housing.

In some embodiments, the first cover unit comprises a first light-transmitting unit, a first annular structure, and a first pressing plate with a first through-hole;

wherein one end of the first annular structure is fixedly attached to the first pressing plate, and the first light-transmitting unit is covered with the first through-hole of the first pressing plate, the first light-transmitting unit and the first gasket are embedded in the first annular structure, and wherein the first light-transmitting unit is compressed on one end of the first gasket and the other end of the first gasket abuts the end of the sleeve.

In some embodiments, the light source protecting assembly further comprises a second gasket and a second pressing plate with a second through-hole; wherein the light source part is attached to one end of the heat sink, the second pressing plate abuts the inner side wall of the sleeve, and the second gasket is pressed against the end of the heat sink by the second pressing plate, and the light emitted by the light source part shone through the second through-hole of the second pressure plate.

In some embodiments, the light source protecting assembly further comprises an intermediate connecting piece which includes a first annular connecting piece and a second annular connecting piece, and the first annular connecting piece is arranged in the hollow part of the second annular connecting piece, the first end of the first annular connecting piece is fixedly attached to the first end of the second annular connecting piece, the inner peripheral surface of the second annular connecting piece and the outer peripheral surface of the first annular connecting piece are arranged at a preset angle; wherein the sleeve includes a sleeve body and a rare end plate of the sleeve that fixedly attached to the sleeve body and is sleeved on the outer peripheral portion of the sleeve body; wherein the second annular connecting piece is fixedly attached to one end of the housing, and wherein the rare end plate of the sleeve is pressed against the end of the housing by the second end of the first annular connecting piece.

In some embodiments, the intermediate connecting piece further comprises a second annular structure and a third annular structure; wherein one end of the second annular structure is fixedly attached to the second annular connecting piece and the other end is fixedly attached to the third annular structure; and wherein a fourth annular structure is fixed to one end of the housing and the inner circumference of the fourth annular structure abuts the outer peripheral surface of the third annular structure, and the end surface of the fourth annular structure abuts the end surface of the second annular structure.

In some embodiments, the housing comprises a tail end cover and a housing body with the hollow inner cavity; the tail end cover is covered with one end of the housing body; wherein a slot with an opening facing downward is disposed on the top end of the housing body and the housing body is fixedly attached to the tail end cover, and the upper end of the tail end cover is engaged in the slot.

A heat sink is disposed in the housing of the light fixture, a first ventilation region and a second ventilation region are disposed on the housing, and a gap between any two adjacent fins is connected with the first ventilation region and the second ventilation region to achieve not only the purpose of heat dissipation, but also form a channel for fluid circulation. At the same time, the blocking mechanism separates the hollow inner cavity of the housing into a first cavity and a second cavity, and the heat sink is in the first cavity. At the same time, the first cavity and the second cavity are isolated from each other to prevent fluids such as water outside the light fixture from entering the second cavity and causing damage to the devices or structures contained in the second cavity.

BRIEF DESCRIPTION OF DRAWINGS

In order to explain the technical solutions in the embodiments of the present disclosure more clearly, the following will briefly introduce the drawings that need to be used in the description of the embodiments or the prior art. Obviously, the drawings in the following description are only for some embodiments, those of ordinary skill in the art can obtain other drawings based on these drawings without creative effort.

Figure 1:
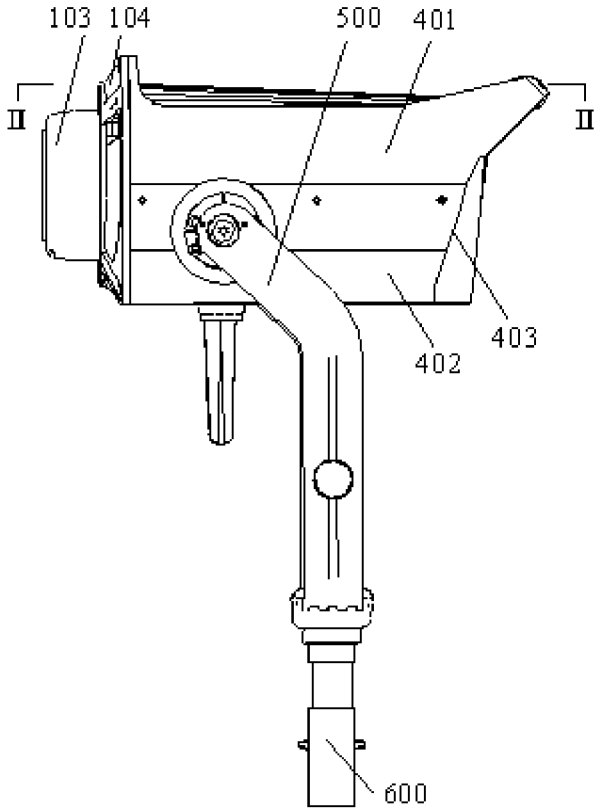
FIG. 1 is a schematic diagram of the external structure of a light fixture according to an embodiment of the present disclosure.

In the figures, every reference number refers to the following: 100—light source protecting assembly, 101—the first cover unit, 1011—the first pressing plate, 1012—the first through-hole, 1013—the first annular, 1014—the first light-transmitting unit, 102—the first gasket, 103—sleeve, 1031—front-end plate of the sleeve, 1032—sleeve body, 1033—rare end plate, 104—intermediate connecting piece, 1041—the first annular connecting piece, 1042—inner peripheral surface of the first annular connecting piece, 1043—the second annular connecting piece, 1044—inner peripheral surface of the second annular connecting piece, 1045—the second annular structure, 1046—outer peripheral surface of the second annular structure, 1047—the third annular structure, 1048—outer peripheral surface of the third annular structure; 105—the second pressing plate, 1051—the second through-hole, 106—the first gasket; 201—light source part, 202—heat sink, 2021—heat pipe, 2022—fins, 2023—heat conducting portion, 203—air-cooling structure, 204—circuit board, 205—heat conducting block, 206—the first supporting plate, 207—the second supporting plate; 300—blocking mechanism, 301—the first rib, 302—the second rib, 303—the third rib, 304—the fourth rib; 400—housing, 401—the first cover, 4011—the first protrusions, 402—the second cover, 4021—the second protrusions, 4022—water penetration holes, 403—tail end cover, 4031—tail end cap, 404—slot, 405—the first ventilation region, 406—the second ventilation region, 407—annular structure, 4071—inner peripheral surface of the fourth annular structure; 500—U-shaped bracket, 600—support rod, 601—hollow insertion channel, 602—the fourth through-hole.

DETAILED DESCRIPTION OF PREFERRED EMBODIMENTS

The following content combines with the drawings and the embodiment for describing the present disclosure in detail. The same or similar reference numerals indicate the same or similar elements or elements with the same or similar functions It is obvious that the following embodiments are only some embodiments of the present invention, but should not be understood as a limitation to the present disclosure.

In the description of the present disclosure, it is to be understood that the orientation or positional relationship indicated by the terms such as "center", "portrait", "landscape", "length", "width", "thickness", "up", "down", "front", "behind", "left", "right", "vertical", "horizontal", "top", "bottom", "inner", "outer" etc. is based on the orientation or positional relationship shown in the drawings, and is only for convenience of description of the present application and simplified description, which is not indicating or implying that the device or component referred to must have a particular orientation, constructed and operated in a particular orientation, thus it is not to be construed as limiting the present disclosure.

Moreover, the terms "first" and "second" are used for descriptive purposes only and are not to be construed as indicating or implying a relative importance or implicitly indicating the number of technical features indicated. Thus, features defining "first" or "second" may include one or more of the described features either explicitly or implicitly. In the description of the present application, the meaning of "a plurality" is two or more unless specifically and specifically defined otherwise.

Figure 2:
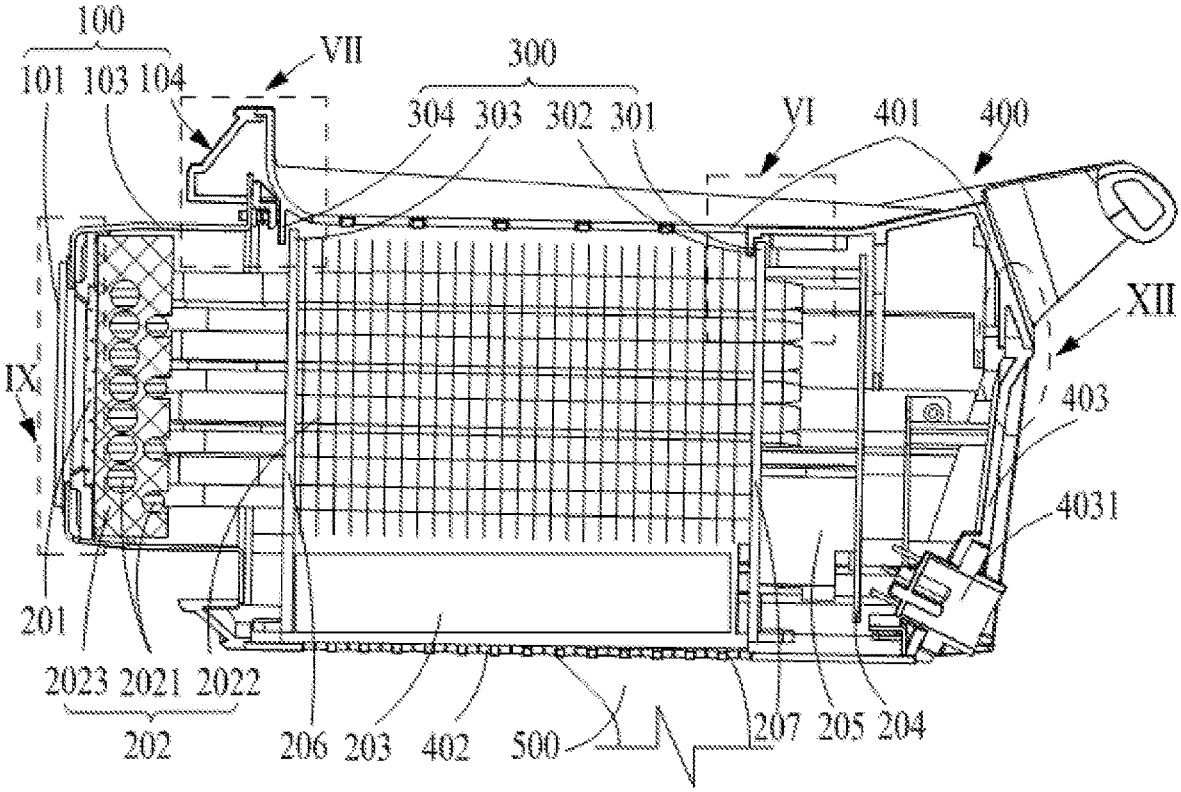
FIG. 2 is a section view of II-II in FIG. 1.
Figure 3:
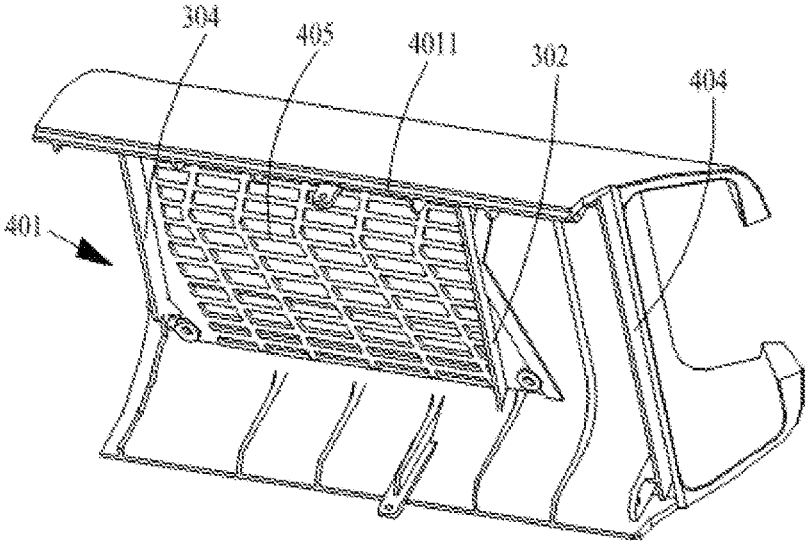
FIG. 3 is a schematic diagram of the structure of a first cover of a light fixture according to an embodiment of the present disclosure.
Figure 4:
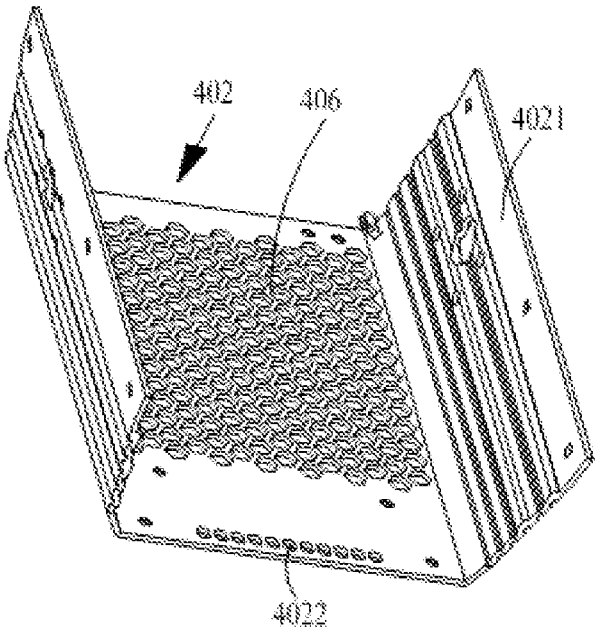
FIG. 4 is a schematic diagram of the structure of the second cover of the light fixture according to an embodiment of the present disclosure.

The present disclosure provides a light fixture. Refer to FIG. 1 and FIG. 2, the light fixture includes a housing 400, a heat sink 202 and a blocking mechanism 300. As shown in FIG. 3 and FIG. 4, the housing 400 has a hollow inner cavity, and a first ventilation region 405 and a second ventilation region 406 are arranged on the housing 400. As shown in FIG. 2, the heat sink 202 is disposed in the hollow inner cavity of the housing, wherein the heat sink 202 includes a plurality of fins 2022 disposed side-by-side corresponding to the first ventilation region 405 and the second ventilation region. The blocking mechanism 300 is disposed between the heat sink and an inner wall of the housing to divide the hollow inner cavity into a first cavity and a second cavity, wherein the plurality of fins are disposed in the first cavity, the first cavity and the second cavity are isolated from each other, and wherein a gap is formed between any two adjacent fins, and the first ventilation region 405, the gap and the second ventilation region are communicating to form a channel.

The light fixture the present disclosure provided is particularly suitable for lighting places such as film and television shooting, and the light fixture is a high-power device. For the high-power light fixture, a heat sink 202 is usually disposed to conduct the heat generated during the operation of the light fixture to the outside of the light fixture in time to avoid affecting the normal state of the light fixture. The heat sink 202 is disposed in the hollow inner cavity of the housing 400. The structure of the housing 400 is not specifically limited, as long as it has a hollow inner cavity structure to easily accommodate the heat sink 202 and other related components.

A first ventilation region 405 and a second ventilation region 406 are disposed on the housing 400. As shown in FIG. 3, the first ventilation region 405 is composed of a plurality of through-holes, for example, it may be strip holes, round holes, a honeycomb-like structure, or other mesh structure. The plurality of through-hole structures penetrate the sidewall of the housing 400 along the thickness direction of the sidewall. Correspondingly, as shown in FIG. 4, the second ventilation region 406 is also composed of a plurality of through-holes, such as a mesh structure such as strip holes, round holes, a honeycomb-like structure, or other mesh structure. The through-holes penetrate the sidewall of the housing 400 along the thickness direction of the sidewall. The first ventilation region 405 and the second ventilation region 406 disposed on the housing 400 facilitate heat dissipation.

As shown in FIG. 2, the housing 400 may include a first cover 401, a second cover 402 and a tail end cover 403. The first cover 401 and the second cover 402 are preferably arranged up and down to form a cylindrical structure with a hollow inner cavity. The cylindrical structure is the housing body, and the tail end cover 403 is closed on one end of the housing body.

Referring to FIG. 3 and FIG. 4, the first protrusions 4011 are disposes on the opposite sides of the first cover 401 respectively, and second protrusions 4021 are disposes on the opposite sides of the second cover 402 respectively. The inner wall surface of the first protrusion 4011 on one side of the first cover 401 is attached to the outer wall surface of the second protrusion 4021 on one side of the second cover 402, and the side of the first cover 401 and the side of the second cover 402 are fastened and connected by fasteners such as bolts. The inner wall surface of the first protrusion 4011 on the other side of the first cover 401 is attached to the outer wall surface of the second protrusion 4021 on the other side of the second cover 402, and the other side of the first cover 401 and the other side of the second cover 402 are fastened and connected by fasteners such as bolts.

Alternatively, the outer wall surface of the first protrusion 4011 on one side of the first cover 401 is attached to the inner wall surface of the second protrusion 4021 on one side of the second cover 402, and the side of the first cover 401 and the side of the second cover 402 are fastened and connected by fasteners such as bolts. The outer wall surface of the first protrusion 4011 on the other side of the first cover 401 is attached to the inner wall surface of the second protrusion 4021 on the other side of the second cover 402, and the other side of the first cover 401 and the other side of the second cover 402 are fastened and connected by fasteners such as bolts.

Wherein, the first ventilation region 405 is preferably arranged at the top of the housing 400, and the second ventilation region 406 is preferably arranged at the bottom of the housing 400. As shown in FIG. 3, the first ventilation region 405 is disposed on the first cover 401; as shown in FIG. 4, the second ventilation region 406 is disposed on the second cover 402.

As shown in FIG. 2, the heat sink 202 generally includes a heat conducting portion 2023, a plurality of heat pipes 2021 and a plurality of fins 2022. The plurality of fins 2022 are arranged side-by-side at intervals along the length direction of the heat pipe 2021. Any heat pipe 2021 passes through a plurality of fins 2022 in sequence, and any fin 2022 is perpendicular to the length direction of the heat pipe 2021. The heat pipe 2021 can be made of materials with good thermal conductivity such as copper. The fins 2022 can be made of materials with good thermal conductivity such as copper or aluminum. One end of any one of the plurality of heat pipes 2021 is fixedly connected to the heat conducting portion 2023. The arrangement of the heat conducting portion 2023 facilitates the heat conductive connection between the heat sink 202 and other components.

As shown in FIG. 3 and FIG. 4, the gaps between the adjacent fins 2022 of the heat sink 202 are respectively connected with the first ventilation region 405 and the second ventilation region 406 to form a channel which fluid (water, air, etc.) can circulate. For example, when fluid such as water outside the housing 400 enters the housing 400 through the first ventilation region 405, the fluid can exit the housing through the second ventilation region 406 after flowing through the gaps between the adjacent fins 2022. It is understandable that the first ventilation region 405 and the second ventilation region 406 are usually arranged on opposite sides of the housing 400. This method is conducive to the formation of convection channels, which is beneficial to leading out the heat generated during the operation of the light fixture and it is also convenient to leading out the fluid entering the housing 400 out in time.

The first supporting plate 206 and the second supporting plate 207 are also contained in the hollow inner cavity of the housing 400. The supporting plate includes a support plate body and a first fixing portion. The first fixing portion and the supporting plate main body are arranged at a preset angle, such as being perpendicular to each other or substantially perpendicular to each other. Wherein the preset angle can be specifically adjusted according to actual requirements. Fasteners such as screws can lock the first fixing portion into the corresponding screw hole of the housing 400 to realize the fixing of the heat sink 202.

When two supporting plates are provided, the first supporting plate 206 and the second supporting plate 207 can be arranged along the length direction of the heat pipe 2021, and any fin 2022 is located between the two supporting plates. A preset angle is set between the length direction of the supporting plate body of the first supporting plate 206 and the supporting plate body of the second supporting plate 207 and the length direction of the heat pipe 2021. The preset angle can be adjusted according to actual requirements. Preferably, the supporting plate body of the first supporting plate 206 and the supporting plate body of the second supporting plate 207 are perpendicular to the length direction of the heat pipe 2021 respectively. Any heat pipe 2021 passes through the body of the two supporting plates in sequence. The supporting plate can support the heat sink 202 uniformly because of the connection between the heat pipe 2021 and the support plate, and the connection between the heat pipe 2021 and the fins 2022.

Alternatively, the supporting body of any one of the two supporting plates is parallel to the length direction of the heat pipe 2021. The two supporting plates are arranged in a direction perpendicular to the length direction of the heat pipe 2021, and any of fins 2022 is located between the two supporting plates. One end of fin 2022 is fixedly connected to the supporting plate body and the other end is fixedly connected to the supporting body of the other supporting plate.

It is understandable that four supporting plates can also be disposed that two are arranged along the length direction of the heat pipe 2021 and the other two are arranged along a direction perpendicular to the length direction of the heat pipe 2021. The four supporting plates are enclosed to form a hollow four-sided cylindrical structure. A plurality of fins 2022 are contained in the above-mentioned hollow four-sided cylindrical structure. As shown in FIG. 2, two supporting plates are preferably disposed. The first supporting plate 206 and the second supporting plate 207 are arranged along the length direction of the heat pipe 2021 and each of them is perpendicular to the heat pipe 2021 respectively. As shown in FIGS. 3 and 4, preferably the first ventilation region 405 and the second ventilation region 406 are located between the first supporting plate 206 and the second supporting plate 207 along the length direction of the heat pipe 2021 so that the fluid entering the housing 400 in the ventilation region 405 and/or the second ventilation region 406 basically enters the area where the fins 2022 are located.

For any supporting plate, four first fixing portions can be disposed. The four first fixing portions can be distributed on the four corners of the support plate main body. Any first fixing portion is fixedly connected to the supporting body, and the two components can also be integrally formed. The first fixing portion may be in the shape of a long plate and perpendicular to the supporting plate body, and is used for a fixed connection with the housing 400 to fix the heat sink 202 inside the housing 400.

As shown in FIG. 2, a blocking mechanism 300 is also contained in the housing 400. The blocking mechanism 300 is disposed between the heat sink 202 and the inner wall of the housing 400. The blocking mechanism 300 is used to separate the hollow inner cavity of the housing 400 into a first cavity and a second cavity. As shown in FIG. 3 and FIG. 4, the heat sink 202 is accommodated in the first cavity, and the plurality of fins 2022 of the heat sink 202 are correspond to the positions of the first ventilation region 405 and the second ventilation region 406.

For example, taking the orientation in FIG. 2 as an example, the left is the front-end of the housing 400, the right is the rear-end of the housing 400, the front is the left side of the housing 400, and the rear is the right side of the housing 400. The first ventilation region 405 and the second ventilation region 406 are respectively located on the upper and lower sides of the plurality of fins 2022, or located on the left and right sides of the plurality of fins 2022, or the first ventilation region 405 is located above the plurality of fins 2022 while the second ventilation region 406 is located on the left side of the plurality of 2022, etc., which will not be listed here. Preferably, the first ventilation region 405 and the second ventilation region 406 are located on the upper and lower sides of the plurality of fins 2022 respectively.

The first ventilation region 405 and the second ventilation region 406 are connected to the first cavity to conduct heat generated during the operation of the light fixture to the outside of the light fixture. Fluids such as water that enters the first cavity from the first ventilation region 405 and/or the second ventilation region 406 can also be drained out of the light fixture through the channel formed by the first ventilation region 405, the gap between the adjacent fins 2022, and the second ventilation region 406.

The first cavity and the second cavity are separated from each other so that fluids such as water will not circulate between the first cavity and the second cavity. In particular, the first cavity and the second cavity are separated from each other, which can prevent fluids such as water circulating from the first cavity into the second cavity.

Fluids such as water outside the light fixture, or fluids that flowing into the first cavity, cannot flow into the second cavity under the blocking action of the blocking mechanism 300, to perform protection damage to the devices or structures contained in the second cavity. It is understandable that there can be one or more second cavities, and the number of second cavities can be set according to actual requirements.

In some embodiments, as shown in FIG. 2 to FIG. 4, the first ventilation region 405, the heat sink 202, and the second ventilation region 406 are arranged along a first direction, and the blocking mechanism 300 separates the first cavity and the second cavity in the second direction. The first direction and the second direction cross with each other in the same plane. In the normal state of the light fixture during working process, the end of the light fixture along the irradiation direction of the light source is the front-end, and the end opposite to the irradiation direction is the tail end.

Still taking the orientation in FIG. 2 as an example, the first ventilation region 405 is disposed on the top of the housing 400, the second ventilation region 406 is disposed on the left side of the housing 400, and the heat sink 202 is disposed in the housing 400. The ventilation region 405, the heat sink 202, and the second ventilation region 406 are arranged in a first direction, and the first direction is the state of firstly along the vertical direction and then the horizontal direction. Alternatively, the first ventilation region 405 can be disposed at the top of the housing 400, the second ventilation region 406 can be disposed at the bottom of the housing 400, and the heat sink 202 is disposed in the housing 400 and located between the first ventilation region 405 and the second ventilation region 405. The first ventilation region 405, the heat sink 202, and the second ventilation region 406 are arranged in a first direction, which is along the vertical direction. The first direction can also be other directions (for example, left and right directions, etc.), which will not be listed here.

The first direction is preferably along the vertical direction. In the following description, the first direction is along the vertical direction as an example. The second cavity obtained by separating the hollow inner cavity of the housing 400 by the blocking mechanism 300 can be formed by enclosing the blocking mechanism 300, the rear of the housing body and the tail end cover 403 of the housing 400, or enclosing the blocking mechanism 300 and the left side wall of the housing 400, or enclosing the blocking mechanism 300 and the right side wall of the housing 400, or enclosing the blocking mechanism 300 and the front part of the housing body, and so on.

The blocking mechanism 300 separates the hollow inner cavity of the housing 400 in the second direction to obtain a first cavity and a second cavity, and isolates the first cavity and the second cavity with each other. Take the second cavity that formed by enclosing the blocking mechanism 300, the rear part of the housing body and the tail end cover 403 of the housing 400 as an example for description. The blocking mechanism 300 isolates the hollow inner cavity of the housing 400 in the horizontal direction to obtain the first cavity and the second cavity, that is, the first cavity and the second cavity are arranged in the horizontal direction. The second direction is along the horizontal direction. The first direction and the second direction are perpendicular to each other in the same plane.

In the structure of the cavity that formed by enclosing, the first ventilation region 405 and the second ventilation region 406 are both located outside the second cavity, so fluids such as water outside the light fixture will not pass through the first ventilation region 405 and/or the second ventilation region 406 to flow into the second cavity. Meanwhile, due to the arrangement of the blocking mechanism 300, fluids such as water flowing into the housing and circulating in the first direction will not flow into the second cavity.

In some embodiments, the light fixture further includes an air-cooling structure 203 which is fixed in the housing 400. The air-cooling structure 203 is located between the heat sink 202 and the second ventilation region 406, and the air outlet surface of the air-cooling structure 203 faces the side of the heat sink 202. Specifically, the air-cooling structure 203 can be a fan, particularly preferably a waterproof fan. The fan surface faces one side of the heat sink 202. For example, the fan is preferably arranged under the heat sink 202, and the fan surface faces the bottom of the heat sink 202. The fan is located between the second ventilation region 406 of the housing 400 and the heat sink 202. It can be understood that the fan is arranged in the housing 400. The fan is arranged under the heat sink 202, therefore it also facilitates the stability of the light fixture to avoid the situation that the weight of the heat sink 202 is inconsistent with the weight of the fan and imbalance if the fan is located on the side of the heat sink 202.

When the first ventilation region 405 is disposed at the top of the housing 400 and the second ventilation region 406 is disposed at the bottom of the housing 400, the air-cooling structure 203 is located between the heat sink 202 and the bottom of the housing 400. Usually, the fluid outside the housing 400 flows into the housing 400 from the first ventilation region 405, and flows out the housing 400 through the gap between the fins 2022 of the heat sink 202 and the second ventilation region 406. The fluid flows in the first direction, that is from top to bottom. At the same time, the air outlet surface of the air-cooling structure 203 is upward, that is, the air blows from bottom to top, and the two directions are opposite, which can achieve a better heat dissipation effect.

In some embodiments, as shown in FIG. 2, the light fixture further includes a light source protecting assembly 100, a light source part 201 and a circuit board 204. The light source protecting assembly 100 which is fixedly connected to the housing 400 has a hollow cavity. The light source part 201 thermally connected to the heat sink 202 is accommodated in the hollow cavity of the light source protecting assembly 100. The circuit board 204 electrically connected to the light source part 201 is accommodated in the second cavity.

When the blocking mechanism 300 separates the hollow inner cavity of the housing 400 to obtain a first cavity and a second cavity, the heat sink 202 is accommodated in the first cavity, and the circuit board 204 is accommodated in the second cavity.

The light source protecting assembly 100 is used to protect the light source part 201 of the light fixture to avoid damage to the light source part 201 caused by external forces or fluids. The light source protecting assembly 100 has a hollow cavity, or at least partial structure of the light source protecting assembly 100 has a hollow cavity for accommodating the light source part 201. The light source protecting assembly 100 has a light-transmitting part for the light of the light source part 201 to pass through.

The circuit board 204 is electrically connected to the light-emitting element of the light source part 201. The circuit board 204 is used to generate signals for driving or controlling the light-emitting elements, such as providing driving power, controlling the magnitude of related current, and adjusting the brightness. The light source part 201 and the circuit board 204 may be located at opposite ends of the heat sink 202, that is, the heat sink 202 is located between the light source part 201 and the circuit board 204. In addition, the circuit board 204 can also be thermally connected to the heat sink 202. Specifically, a heat conducting block 205 can be disposed one end of which is fixedly connected to the heat sink 202 and the other end is fixedly connected to the circuit board 204.

In the following description, the arrangement of the first ventilation region 405, the heat sink 202 and the second ventilation region 406 in the vertical direction is taken as an example. As shown in FIG. 2-FIG. 4, when the first ventilation region 405, the heat sink 202, and the second ventilation region 406 are arranged in the vertical direction, the light source protecting assembly 100, the first cavity and the second cavity are arranged in a horizontal sequence. The light source protecting assembly 100 may be located at the head of the housing 400, and the second cavity may be located at the tail of the housing 400. That is, the blocking mechanism 300, partial structure of the housing body and the tail end cover 403 enclose to form the second cavity, and the circuit board 204 is accommodated in the second cavity. The first cavity is arranged in the middle of the housing 400 between the light source protecting assembly 100 and the second cavity, and the first cavity is used for accommodating the heat sink 202. It can be understood that, in order to facilitate the thermal connection between the light source part 201 and the heat sink 202, a part of the heat pipe 2021 of the heat sink 202 can penetrate the first supporting plate 206 and extend into the hollow cavity of the light source protecting assembly 100.

The light source part 201 is accommodated in the hollow cavity of the light source protecting assembly 100, and the circuit board 204 is accommodated in the second cavity, which can effectively protect both the light source part 201 and the circuit board 204, and prevent the light source part 201 and the circuit board 204 from fluid damage. Moreover, when the hollow cavity of the light source protecting assembly 100 and the second cavity are respectively located at opposite ends of the heat sink 202, it is convenient for the light source part 201 and the circuit board 204 to be thermally connected to the heat sink 202 respectively, and it can also avoid adverse effect of the heat generated during the working process of the light source part 201 on the circuit board 204.

Wherein, referring to FIG. 4, a plurality of water penetration holes 4022 are disposed on the second cover 402. The water penetration holes 4022 penetrate the second cover 402 along the thickness direction of the second cover 402. The water penetration holes 4022 are connected with the second cavity. If fluid such as water flows into the second cavity, it can be drained out from the housing 400 through the water penetration holes 4022 in time.

In some embodiments, referring to FIG. 2, the blocking mechanism 300 includes a first rib 301 contained in the housing 400. A groove (not shown in the figure) is disposed on an inner side wall of the housing 400, and at least the upper outer peripheral portion of the first rib is engaged in the groove. The first rib and the inner wall of the housing enclose to form the second cavity, and the first ventilation region 405 and the second ventilation region are located outside the second cavity. The circuit board contained in the second cavity is thermally connected to the heat sink.

In the following description, the structure in which the light source protecting assembly 100, the first cavity and the second cavity are arranged horizontally is still taken as an example. The first rib 301 is generally a plate-like structure. The first rib 301 is placed in the housing 400 and located on the side of the heat sink 202. The first rib 301, the partial structure of the housing body and the tail end cover 403 of the housing 400 forms a second cavity in which the circuit board 204 is contained.

The length directions of the first rib 301 and the heat pipe 2021 can be perpendicular or substantially perpendicular to each other, or they can be arranged at other preset angles as long as the first rib 301, the partial structure of the housing body and the tail end cover 403 of the housing 400 is convenient to enclose to form the second cavity so as to prevent fluids such as water outside the housing 400 or that flowing in the first direction from entering the second cavity.

Preferably, the longitudinal directions of the first rib 301 and the heat pipe 2021 are perpendicular to each other. As a specific implementation of forming the second cavity, a first groove is disposed on the inner side wall of the housing 400, and the position of the first groove corresponds to the position of the first rib 301 so that the outer peripheral part of the first rib 301 can be clamped in the first groove.

For ease of description, the first rib 301 may include an upper outer peripheral portion and a lower outer peripheral portion which constitute the outer peripheral portion of the first rib 301.

Wherein, it is possible to open a groove on the top of the housing 400, and the length of the groove can be specifically adjusted according to actual requirements. Only the upper outer peripheral portion of the first rib 301 is clamped in the groove, and the lower peripheral portion of the first rib 301 and the bottom of the housing 400 may be spaced apart in a certain distance, in contact with each other or contact with each other in other ways. At this time, the first rib 301 can be fixed to other structures in the housing 400 through at least one supporting rod to realize the fixed arrangement of the first rib 301. In this structure, the first rib 301, partial structure of the housing body and the tail end cover 403 enclose to from the second cavity.

In some embodiments, the first rib 301 can also be arranged along the circumferential direction of the housing body, and an annular groove is disposed on the inner side wall of the housing 400; accordingly, the outer peripheral portion of the first rib 301 is correspondingly clamped in the annular groove. In this structure, the first rib 301, the partial structure of the housing body and the tail end cover 403 enclose to form the second cavity. Wherein, the first groove located on the housing 400 other than the first ventilation region 405 and the second ventilation region 406 does not pass through the first ventilation region 405 and the second ventilation region 406. When the first rib 301 is clamped in the first groove, the first ventilation region 405 and the second ventilation region 406 are both located outside the enclosed second cavity.

When the first supporting plate 206 and the second supporting plate 207 are surrounded on the periphery of the fins 2022, the first rib 301 can be located on the side of any supporting plate. Alternatively, the first rid 301 can also be directly fixed on a supporting plate, and the two can also be integrally formed.

Figure 5:
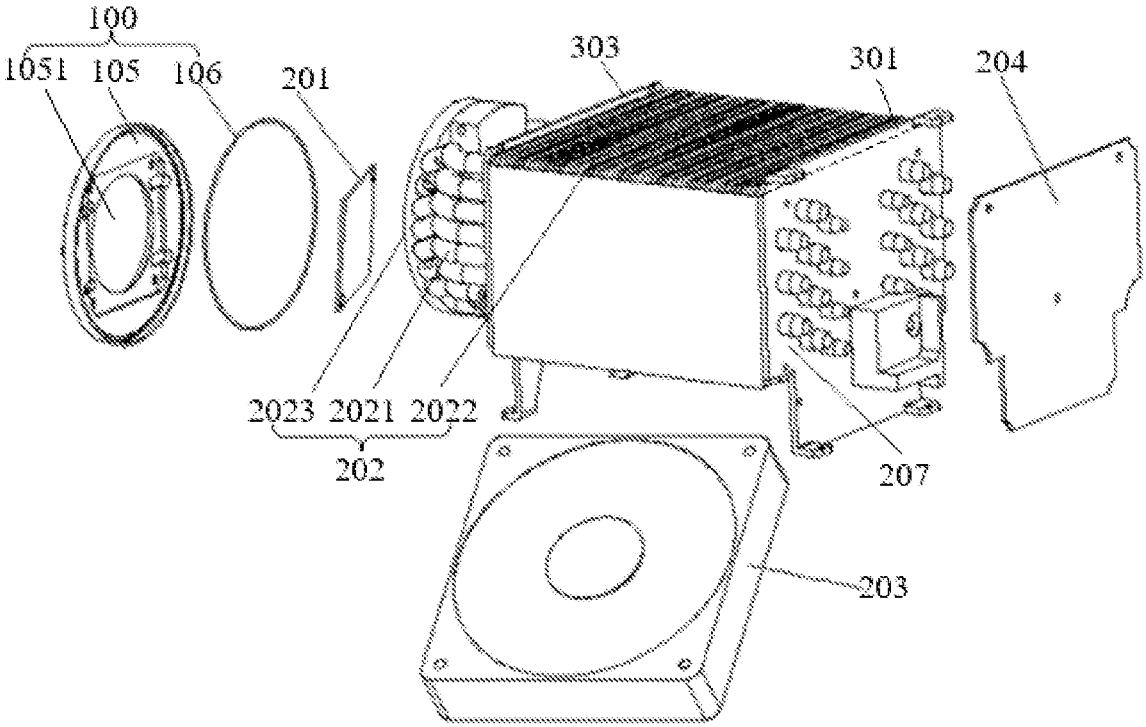
FIG. 5 is a schematic diagram of the installation of the light source part and the heat sink of the light fixture according to an embodiment of the present disclosure.

For example, as shown in FIG. 2 and FIG. 5, for the first supporting plate 206 and the second supporting plate 207 arranged along the length direction of the heat pipe 2021, the second supporting plate 207 is close to the tail end cover 403 of the housing 400. The first rib 301 can be integrally formed with the second supporting plate 207; or the first rib 301 is a separate component which is fixedly connected to the second supporting plate 207 by engaging structures, fasteners or sealing rubber rings.

At the same time, the first rib 301 and the second supporting plate 207 form a plate-like structure by means of fixed connection or integral molding. The first rib 301 can be a plate-like structure fixedly arranged on the upper part of the second supporting plate 207. The first rib 301 can also be an annular structure, and the shape and size of the inner annular part of the first rib 301 are as same as the second supporting plate 207. The second supporting plate 207 is fixedly arranged in the hollow part of the inner annular of the first rib 301 and the first rib 301 is fixedly connected to the second supporting plate 207. When the first rib 301 is fixedly connected to the second support plate 207, the first rid 301, the second supporting plate 207, the partial structure of the housing 400 and the tail end cover 403 enclose to from a second cavity.

During the working process of the light fixture, usually the top of the housing 400 faces upwards. Therefore, when only the upper peripheral portion of the first rib 301 is clamped in the groove, it can still be effectively waterproof; and when the whole outer peripheral portions of the first ribs 301 are correspondingly clamped in the grooves arranged circumferentially along the inner side wall of the housing 400, the circuit board 204 contained in the second cavity can be more effectively protected. Moreover, the structure in which the first rib 301 is matched with the groove is adopted, and the first rib 301 is not connected to the housing 400, which also facilitates the installation and disassembly of the housing 400 and other components contained in the housing 400.

Figure 6:
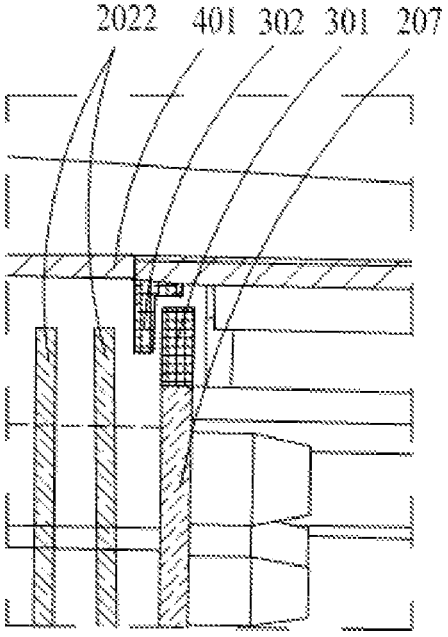
FIG. 6 is a detailed view of position VI of FIG. 2 according to an embodiment of the present disclosure.

In some embodiments, as shown in FIG. 2 and FIG. 6, the blocking mechanism 300 includes a first rib 301 disposed in the housing 400, and a second rib 302 fixed to the inner side wall of the housing 400. The second rib 302 extends from the inner side wall of the top of the housing 400 to the hollow cavity of the housing 400. The second rib 302 is attached to the first rib 301, and at least partially overlaps with the first rib 301. The first rib 301, the second rib 302 and the inner wall of the housing 400 enclose to form a second cavity. And the first ventilation region 405 and the second ventilation region 406 are located outside the second cavity. The circuit board 204 is thermally connected to the heat sink 202 and is accommodated in the second cavity.

As another specific implementation of forming the second cavity, a first rib 301 is fixedly disposed in the housing 400. Meanwhile, and a second rib 302 is also fixed on the inner side wall of the housing 400. The second rib 302 extends from the inner side wall of the housing 400 toward the hollow cavity of the housing 400, and the length of the extension can be specifically set according to actual requirements. Both the first rib 301 and the second rib 302 preferably have a plate-like structure. The first rib 301, the second rib 302, the partial structure of the housing body and the tail end cover 403 of the housing 400 form a second cavity in which the circuit board 204 is contained. Wherein, as shown in FIG. 2 to FIG. 4, the position where the second rib 302 is connected to the housing 400 does not pass through the first ventilation region 405 and the second ventilation region 406 and is located on the other part of the housing 400 except the first ventilation region 405 and the second ventilation region 406. When the first rib 301 is attached to the second rib 302 and at least partially overlaps with the second rib 302, the first ventilation region 405 and the second ventilation region 406 are both located outside the enclosed second cavity.

The first rib 301 and the second rib 302 are perpendicular to the length direction of the heat pipe 2021 respectively, or they can be arranged at other preset angles, as long as the first rib 301, the second rib 302, and the partial structure of housing body and the tail end cover 403 of the housing 400 are convenient to enclose to form the second cavity to prevent fluids such as water outside the housing 400 or that flowing in the first direction from entering the second cavity.

Preferably, the first rib 301 and the second rib 302 are perpendicular to the length direction of the heat pipe 2021 respectively. The position of the second rib 302 corresponds with the position of the first rid 301. The second rid 302 is close to the first rid 301, and the two can be attached together or have a small gap.

As shown FIG. 3, a second rib 302 is disposed on the inner side wall of the housing 400. As a specific implementation, when the first rid is perpendicular to the length direction of the heat pipe 2021, the second rib 302 is also preferably perpendicular to the length direction of the heat pipe 2021. The second rid 302 may be integrally formed with the housing 400 or fixed on the inner wall of the housing 400. When the first rid 301 is a plate-like structure fixed on the upper side of the second supporting plate 207, the second rid 302 can be disposed on the top inner wall of the housing 400, and the second rid 302 which is close to the first rid 301 can extend from the top inner wall of the housing 400 to the housing to the hollow inner cavity of the housing 400. In addition, the length of the first rid 301 and the second rid 302 can be specifically adjusted according to actual requirements, and the second rid 302 and the first rid 301 are at least partially overlap with each other. At this time, the first rid 301, the second rid 302, the second supporting plate 207, the rear of the housing body and the tail end cover 403 of the housing 400 enclose to form the second cavity.

As another specific implementation, when the first fin 301 is fixed on the outside of the second supporting plate 207 as an annular structure surrounding, the second rib 302 can also be disposed as an annular structure in the circumferential direction of the housing body. The second rib 302 of the annular structure is disposed on the inner side wall of the housing 400. The second rib 302 which is close to the first rid 301 extends from the inner wall of the housing 400 to the hollow inner cavity of the housing 400. The annular second rib 302 and the annular first rib 301 are at least partially overlap with each other at each intersection.

It is understandable that the first fin 301 and the second rib 302 can also be composed of two mutually discontinuous parts. For example, the first fin 301 may include a first sub-rib fixed on the upper side of the second supporting plate 207 and a second sub-rib fixed on the lower side of the second supporting plate 207. The second rib 302 may include a third sub-rib fixed to the inner wall of the top of the housing 400 and a fourth sub-rib fixed to the inner wall of the bottom of the housing 400. The third sub-rib is close to the first sub-rib and the two sub-ribs are at least partially overlap with each other, and the fourth sub-rib is close to the second sub-rib and sub-ribs are at least partially overlap with each other. At this time, there is a certain gap between the opposite sides of the second supporting plate 207 corresponding to inner side wall of the housing 400.

During the working process of the light fixture, usually the top of the housing 400 faces upwards. Therefore, when the second rib is disposed on the inner side wall of the top of the housing 400 and the first rib 301 and the second rib 302 partially overlap, it can still be effectively waterproof. And when the first rib and the second rib are both annular structures, the circuit board 204 contained in the second cavity can be more effectively protected. Moreover, the structure in which the first rib 301 is matched with the second rib 302 is adopted, and the first rib 301 is not connected to the housing 400, which also facilitates the installation and disassembly of the housing 400 and other components contained in the housing 400.

In some embodiments, as shown in FIG. 2 and FIG. 5, the blocking mechanism 300 includes a third rib 303 fixedly disposed in the housing 400. At least the upper peripheral portion of the third rib 303 is in a sealing fit with the housing 400, the third rib 303 and the inner wall of the housing 400 enclose to form a third cavity, the first ventilation region 405 and the second ventilation region 406 is located outside the third cavity, and the third cavity is communicating with the hollow cavity of the light source protecting assembly 100.

Specifically, the first cavity, the second cavity, and the third cavity are all cavities obtained by matching the blocking mechanism 300 and the housing 400. It is understandable that the third cavity may be one of a plurality of second cavities. In order to distinguish it from other second cavities, the third cavity is used for specific description. Moreover, when the third rib 303 and the inner wall of the housing 400 form a third cavity, the size of the third cavity can be set according to actual requirements. The orientation in FIG. 2 is taken as an example for illustration. The length of the third cavity can be very small in the horizontal direction. The third cavity is communicating with the hollow cavity of the light source protecting assembly 100, so that the hollow cavity contained in the light source protecting assembly 100 is further isolated from the first cavity to preventing fluids such as water in the first cavity from flowing in the second direction into the hollow cavity of the light source protecting assembly 100; therefore the light source protecting assembly 100 protects the light source part 201, and the blocking mechanism 300 can further protect the light source part 201.

The third rib 303 has a plate-like structure. The structure and arrangement state of the third rib 303 can be the same as that of the first fin 301. The following only takes the structure of the third rib 303 fixed on the first supporting plate 206 as an example for description. When the third rib 303 is fixed on the first supporting plate 206 which is perpendicular to the length direction of the heat pipe 2021, the third rib 303 is also perpendicular to the length direction of the heat pipe 2021.

The structure in which the light source protecting assembly 100, the first cavity and the second cavity are arranged horizontally is still taken as an example as following. When a second groove (not shown in the figure) is disposed on the inner side wall of the top of the housing 400, the third rib 303 can be a plate-like structure fixed on the upper side of the first supporting plate 206, and the upper outer periphery of the third rib 303 is clamped in the second groove. In some embodiments, the third rib 303 may be an annular structure, and the outer peripheral portion is correspondingly clamped in the second an annular groove.

When the third rib 303 is an annular structure, the shape and size of the inner annular portion of the third rib 303 are the same as those of the first supporting plate 206, and the first support plate 206 is fixed to the inner hollow annular part of the third rid 303.

The third rib 303 and the first supporting plate 206 can also be integrally formed. In this structure, the third rib 303 and the partial structure of the housing 400 enclose to form a third cavity which is connected with the hollow cavity of the light source protecting assembly 100 to form a light source accommodating cavity. The light source part 201 is accommodated in the light source accommodation cavity. Wherein, as shown in FIG. 2 to FIG. 4, the second groove and is located on the other part of the housing 400 except the first ventilation region 405 and the second ventilation region 406 without passing through the first ventilation region 405 and the second ventilation region 406. When the first fin 301 is clamped in the second groove, the first ventilation region 405 and the second ventilation region 406 are both located outside the enclosed third cavity and outside the light source accommodating cavity.

Figure 7:
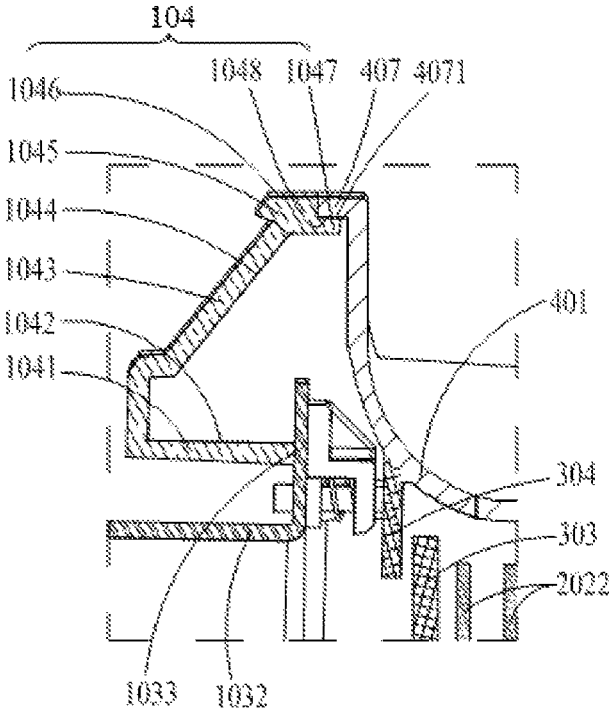
FIG. 7 is a detailed view of position VII of FIG. 2 according to an embodiment of the present disclosure.

As shown in FIG. 2, FIG. 5, and FIG. 7, when the fourth rib 304 is fixed on the inner side wall of the housing 400, the third rib 303 and the fourth rib 304 are close to each other and partially overlap. Wherein, the third rib 303 and the fourth rib 304 can be attached to each other, or a certain gap between them. The fourth rib 304 and the third rib 303 are preferably parallel to each other.

Specifically, as a specific implementation manner, the third rib 303 can be a plate-shaped structure fixed on the upper side of the first supporting plate 206, and the fourth rib 304 is fixed on the inner side wall of the top of the housing 400. In addition, the fourth rib 304 that attached to the third rib 303 extends from the inner wall of the housing 400 to the hollow cavity of the housing 400, and the fourth rib 304 and the third rib 303 at least partially overlap with each other.

As another specific implementation, when the third rib 303 is an annular structure fixed around the outside of the first supporting plate 206, the fourth rib 304 is also an annular structure. The fourth rib 304 close to the third rib 303 extends from the inner side wall of the housing 400 to the hollow cavity of the housing 400. And the fourth rib 304 and the third rib 303 at least partially overlap with each other. The shape and size of the inner annular portion of the third rib 303 are the same as those of the first supporting plate 206, and the first supporting plate 206 is fixed to the hollow inner annular portion of the third rib 303. The third rib 303, the fourth rib 304 and partial structure the housing body enclose to form a third cavity which connected with the hollow cavity of the light source protecting assembly 100 to form a light source accommodating cavity. The light source part 201 is accommodated in the light source accommodating cavity. Wherein, as shown in FIG. 2 to FIG. 4, the fourth rib 304 is located on the other part of the housing 400 except the first ventilation region 405 and the second ventilation region 406 without passing through the first ventilation region 405 and the second ventilation region 406. When the third rib 303 and the fourth rib 304 are attached to each other and at least partially overlap, the first ventilation region 405 and the second ventilation region 406 are both located outside the enclosed third cavity and located outside the light source accommodating cavity.

The arrangement state and the positional relationship of the third rib 303, the fourth rib 304 and the second groove between each other are same as those of the first fin 301, the second rib 302 and the first groove. There may be many combination modes for forming the second cavity and the third cavity. For example, it may be a structure in which the first fin 301 is matched with the first groove to form the second cavity, and the third rib 303 is matched with the fourth rib 304 to form the third cavity. It can also be the structure matched with the first fin 301 and the second rib 302 to form the second cavity, and the structure matched with the third rib 301 and the fourth rib 302 to form the third cavity. The others are not listed here.

The following takes the first fin 301 matched with the second rib 302 to form the second cavity, and the third rib 303 matched with the fourth rib 304 to form the third cavity as an example to explain the specific form or structure of the first cavity, the second cavity, and the third cavity in the housing 400.

The first fin 301 is an annular plate structure, and the shape and size of the inner hollow part of the annular plate structure are the same as the second supporting plate 207. The second supporting plate 207 is arranged in the inner hollow part of the first fin 301. The second supporting plate 207 and the first fin 301 are fixedly connected or integrally formed. Correspondingly, a second rib 302 in annular shape is fixed on the inner side wall of the housing 400, and the second rib 302 extends from the inner side wall of the housing 400 to the hollow inner cavity of the housing 400. As shown in FIG. 6, the second rib 302 is attached to the first fin 301 that makes them at least partially overlap. At this time, the first fin 301, the second rib 302, the second supporting plate 207, the partial structure of the housing body and the tail end cover 403 enclose to form the second cavity, and the circuit board 204 is accommodated in the second cavity. When the second supporting plate 207 has a heat conduction function, one end of the heat conduction block 205 is fixedly connected to the second supporting plate 207. When the second supporting plate 207 has no heat conduction function, one end of the heat conduction block 205 passes through the second supporting plate 207 to fixedly connected with one of the fins 2022, and the heat conducting block 205 and the second supporting plate 207 can be sealedly matched. The other end of the heat conducting block 205 is fixedly connected to the circuit board 204.

The third rib 303 is an annular plate structure, and the shape and size of the inner hollow part of the annular plate structure are the same as the first supporting plate 206. The first supporting plate 206 is arranged in the inner hollow part of the first fin 303. The first supporting plate 206 and the third rib 303 are fixedly connected or integrally formed. Correspondingly, a fourth rib 304 in annular shape is fixed on the inner side wall of the housing 400, and the fourth rib 304 extends from the inner side wall of the housing 400 to the hollow inner cavity of the housing 400. As shown in FIG. 7, the fourth rib 304 is attached to the third rib 303 that makes them at least partially overlap. At this time, as shown in FIG. 2, the third rib 303, the fourth rib 304, the first supporting plate 206, and the partial structure of the housing body enclose to form the third cavity. The third cavity is communicating with the hollow cavity of the light source protecting assembly 100, and the light source part 201 is accommodated in the hollow cavity of the light source protecting assembly 100.

As shown in FIG. 2-FIG. 4, the position where the third rib 303 connected to the housing 400 and the position where the fourth rib 304 connected to the housing 400 are both located on the other part of the housing 400 except the first ventilation region 405 and the second ventilation region 406. Along the length direction of the heat pipe 2021, the first ventilation region 405 and the second ventilation region 406 are located between the third rib 303 and the fourth rib 304, which can effectively avoid the fluid flowing into de housing 400 from the first ventilation region 405 and/or the second ventilation region 406 to entering the second cavity or the third cavity.

Figure 8:
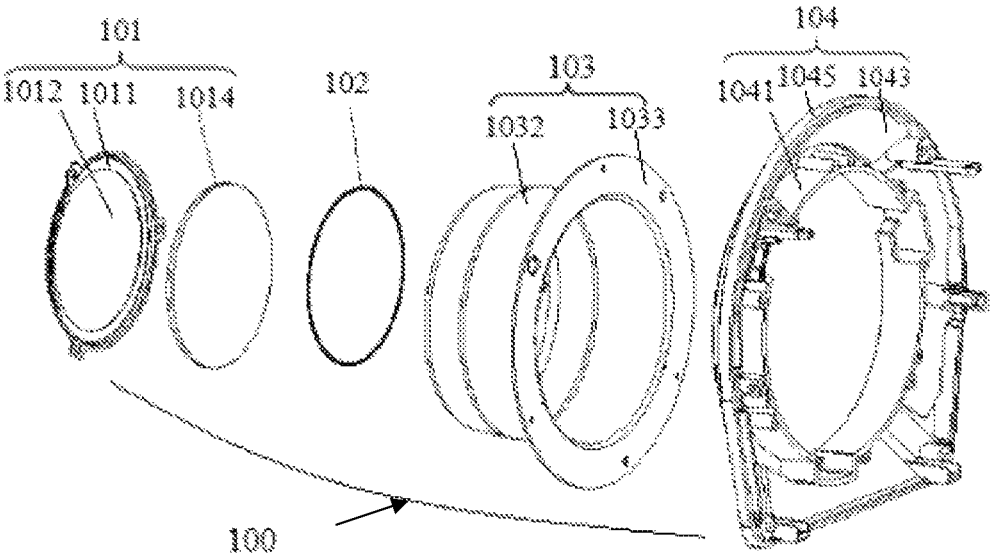
FIG. 8 is a schematic diagram of the installation of the light source protecting assembly according to an embodiment of the present disclosure.
Figure 9:
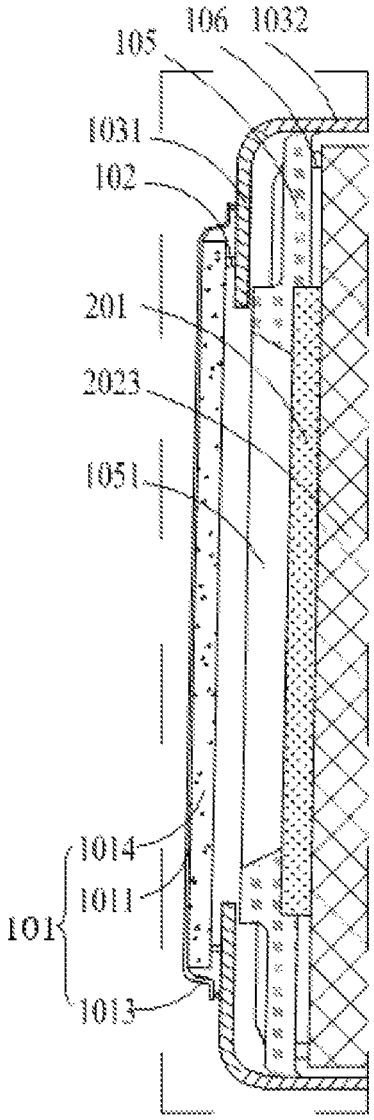
FIG. 9 is a detailed view of position IX of FIG. 2 according to an embodiment of the present disclosure.

In some embodiments, referring to FIG. 8, the light source protecting assembly 100 comprises a sleeve 103 with a hollow cavity, a first gasket 102, and a first cover unit 101 with a first light-transmitting part. As shown in FIG. 9, the light source part 201 is sleeved in the hollow cavity of the sleeve 103, the first cover unit 101 presses the first gasket onto one end of the sleeve 103, and the first cover unit 101 is fixed on the sleeve 103 the other end of which is fixedly attached to the housing 400.

Figure 10:
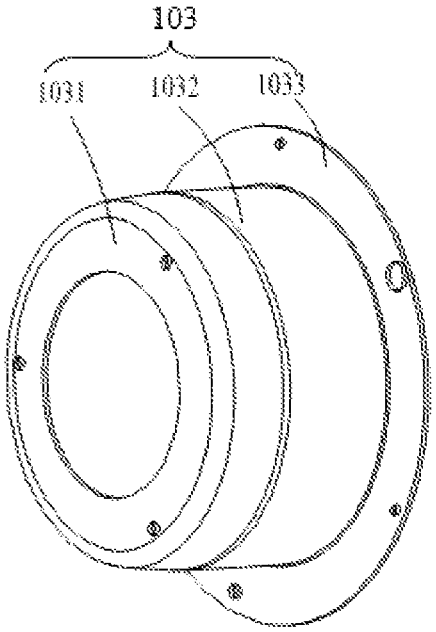
FIG. 10 is a schematic diagram of the structure of a sleeve according to an embodiment of the present disclosure.

Specifically, referring to FIG. 10, the sleeve 103 is a cylindrical structure with a hollow cavity and both ends of the sleeve have openings. For ease of description, unless otherwise specified, the end of the light fixture along the irradiation direction of the light source part 201 is the front-end, and the end opposite to the irradiation direction is the tail end of the light fixture. The sleeve 103 includes a sleeve body 1032, a front-end plate 1031 of the sleeve on the front-end of the sleeve body 1032, and a rare end plate 1033 of the sleeve on the rear-end of the sleeve body 1032. The rare end plate 1033 of the sleeve extends from the sleeve body 1032 to the outer peripheral portion of the sleeve body in the radial direction of the sleeve body 1032. In the following description, the sleeve body 1032 is a hollow cylindrical structure as an example.

A first opening is disposed on the front-end plate 1031 of the sleeve with the size that specifically set according to actual requirements. The first opening penetrates the front-end plate 1031 of the sleeve along the thickness direction of the front-end plate 1031 of the sleeve and connected with the hollow cavity of the sleeve 103. The diameter of the first opening is usually slightly smaller than that of the sleeve body 1032 to facilitate the connection of the sleeve 103 with other structures.

The second opening on the end of the sleeve 103 is usually the same as the diameter of the sleeve body 1032, and the second opening is connected with the hollow cavity of the sleeve body 1032. The rare end plate 1033 of the sleeve which is easily connected with other structures can be disposed according requirements. The light source part 201 is accommodated in the sleeve 103, and the light emitted by the light source part 201 is transmitted through the first opening of the front-end plate 1031 of the sleeve.

Wherein, at least a vent (not shown in the figure) can be disposed on the lower side wall of the sleeve body 1032, and usually two to three vents are sufficient. The vent penetrates the lower side wall of the sleeve body 1032 along the radial direction of the sleeve body 1032 and is used to conduct the heat generated in the working state of the light source part 201 out of the sleeve 103. It is understandable that the aperture of the vents is relatively small to improve the heat dissipation without fluids such as water outside the sleeve 103 flowing into the sleeve 103 through the vent. In addition, the vents are usually disposed on the lower side wall of the sleeve body 1032, which can further prevent fluids such as water from flowing into the sleeve 103.

Referring to FIG. 8 and FIG. 9, the first gasket 102 which can be deformed when subjected to an external force is a ring-shaped gasket with a hollow center. The first gasket 102 can be made of silica gel, rubber, or other elastic materials, as long as it has a sealing performance and a certain resistance to liquid substances such as water or high temperature conditions.

As shown in FIG. 10, the first gasket 102 is located outside the sleeve 103 and is attached to the front-end plate 1031 of the sleeve. Its axis is parallel to the axis of the sleeve 103, preferably is coincident to each other. The diameter of the inner peripheral surface of the first gasket 102 is equal to or larger than the diameter of the first opening on the front-end plate 1031 of the sleeve. Usually, the diameter of the inner peripheral surface of the first gasket 102 is larger than the diameter of the first opening on the front-end plate 1031 of the sleeve, and the thickness of the first gasket 102 in the radial direction is small, as long as it can meet the requirements of sealing. Wherein, the diameter of the outer peripheral surface of the first gasket 102 is usually equal to or slightly smaller than the diameter of the front-end plate 1031 of the sleeve to facilitate the fixed connection between the first cover unit 101 and the sleeve 103.

The first cover unit 101 is located outside the sleeve 103 and on the front-end of the sleeve 103. The first cover unit 101 is used to press the first gasket 102 onto the front-end plate 1031 of the sleeve. In addition, as shown in FIG. 9, the first cover unit 101 has a first light-transmitting part, so that the light emitted by the light source part 201 can pass through the first light-transmitting part to realize the function of illumination.

Specifically, the first gasket 102 is located between the first cover unit 101 and the front-end plate 1031 of the sleeve. After the first cover unit 101 and the sleeve 103 are fixedly connected, the first gasket 102 is received the squeezing pressure from the first cover unit 101 and the front-end plate 1031 of the sleeve to tightly fit between the front-end plate 1031 of the sleeve and the first cover unit 101 to play a role of sealing and waterproofing. It is understandable that the first cover unit 101 and the first gasket 102 can also be located in the sleeve 103. The first cover unit 101 presses the first gasket 102 onto the front-end plate 1031 of the sleeve. This structure can also be used to achieve the effect of sealing and waterproofing, but its operation convenience is not as good as the structure in which the first cover unit 101 and the first gasket 102 are located outside the sleeve 103. In this embodiment, the structure in which the first cover unit 101 and the first gasket 102 are located outside the sleeve 103 is taken as an example.

Specifically, the connection manner between the first cover unit 101 and the sleeve 103 may not be specifically limited, as long as it is easy to connect the first cover unit 101 and the sleeve 103 and to compress the first gasket 102 tightly. As a specific implementation manner, a plurality of first screw holes may be disposed in a position close to the outer periphery of the first cover unit 101, and the plurality of first screw holes are distributed along the circumferential direction of the first cover unit 101. Correspondingly a plurality of second screw holes which can be connected with a plurality of connectors are disposed on the sleeve 103. Wherein, the first screw holes can be directly opened on the first cover unit 101, the second screw holes can also be directly opened on the sleeve 103, and the first screw holes or the second screw holes can also be opened on a protruding structure of the first cover unit 101 and the sleeve 103. The protruding structure is for facilitating connection.

It is understandable that the opening of the first screw holes and the second screw holes should not affect the sealing requirements. For example, the second screw holes should be opened on the sleeve 103 close to its outer periphery, and the second screw holes and the hollow cavity of the sleeve 103 are not connected. The position where the first screw holes is opened should not cause water to enter the area between the first cover unit 101 and the sleeve 103 from the first screw hole. For example, the distance between the center points of first cover unit 101 and the first screw holes should be equal to or greater than the radius of the outer peripheral surface of the first gasket 102.

Wherein, the light source part 201 is sleeved in the hollow cavity of the sleeve 103, and the light source part 201 is arranged toward the first light-emitting part of the first covering unit 101. When it is powered on, the light emitted by the light source part can be transmitted through the first light-transmitting part of the first cover unit 101 to play a role of illumination. With the above structure, the sealing structure of the light source protecting assembly 100 prevents liquid substances such as water outside the light source protecting assembly 100 from entering the sleeve 103 to avoid damage to the light source part 201. At the same time, liquid substances such as water will not enter the area between the first cover unit 101 and the sleeve 103, so as not to affect the lighting effect.

Figure 11:
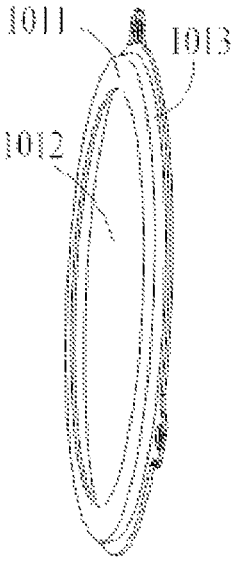
FIG. 11 is a schematic diagram of the structure of the first cover unit according to an embodiment of the present disclosure.

According the basis of the foregoing embodiments, this embodiment provides a light fixture. As shown in FIG. 9 and FIG. 11, the first cover unit 101 includes a first light-transmitting unit 1014, a first annular structure 1013 and a first pressing plate with a first through-hole 1012. One end of the first annular structure is fixedly attached to the first pressing plate 1011, and the first light-transmitting unit 1014 is covered with the first through-hole 1012 of the first pressing plate 1011. The first light-transmitting unit 1014 and the first gasket 102 are embedded in the first annular structure 1013, wherein the first light-transmitting unit 1014 is compressed on one end of the first gasket 102 and the other end of the first gasket 102 abuts the end of the sleeve 103.

The specific shape of the first pressing plate 1011 is not limited. In the direction perpendicular to the axis of the sleeve 103, when the cross-sectional shape of the first opening on the front-end plate 1031 of the sleeve is circular, the cross-sectional shape of the first pressing plate 1011 is also preferably circular. A first through-hole 1012 is disposed on the first pressing plate 1011, and the first through-hole 1012 penetrates the first pressing plate 1011 along the thickness direction of the first pressing plate 1011. Along the plane direction perpendicular to the axis of the first through-hole 1012, the cross-sectional shape of the first through-hole 1012 is also preferably circular. The first through-hole 1012 is used to transmit the light emitted by the light source part 201, and its diameter is usually greater than or equal to the diameter of the first opening on the front plate 1031 of the sleeve.

The first light-transmitting unit 1014 is usually a high-temperature resistant protective lens, and other protective and light-mixable optical lenses (for example, double spectacle lenses) are also optional. Along the direction perpendicular to the axis of the first light-transmitting unit 1014, the cross-sectional shape of the first light-transmitting unit 1014 is also preferably circular. The diameter of the first light-transmitting unit 1014 is larger than the diameter of the first through-hole 1012 and larger than the diameter of the first opening on the front plate 1031 of the sleeve. The first light-transmitting unit 1014 is covered at the first through-hole 1012 of the first pressing plate 1011 to form the first light emitting part of the first covering unit 101.

As a specific implementation, the diameter of the first light-transmitting unit 1014 is equal to or smaller than the diameter of the inner peripheral surface of the first gasket 102, and along the axial direction of the sleeve 103, the thickness of the first light-transmitting unit 1014 is smaller than the width of the first gasket 102. Then the first gasket 102 surrounds the outer circumference of the first light-transmitting unit 1014, and the first pressing plate 1011 directly presses the first gasket 102 on the front-end plate 1031 of the sleeve. In addition, when the first pressing plate 1011 presses the first gasket 102, it also presses the first light-transmitting unit 1014 on the front-end plate 1031 of the sleeve. The first through-hole 1012 of the first pressing plate 1011 and the first opening of front-end plate 1031 of the sleeve are tightly covered with the first light-transmitting unit 1014.

As another specific implementation manner, the diameter of the first light-transmitting unit 1014 is greater than the diameter of the inner peripheral surface of the first gasket 102. Then the first light-transmitting unit 1014 presses the first gasket 102 on the front-end plate 1031 of the sleeve, and the first pressing plate 1011 is then pressed against the first light-transmitting unit 1014 to connect the first light-transmitting unit 1014 and the first washer 102 is pressed on the front-end plate 1031 of the sleeve. That is, along the axial direction of the sleeve 103, the first pressing plate 1011, the first light-transmitting unit 1014, the first gasket 102 and the sleeve 103 are arranged in sequence. The first pressing plate 1011 can not only compress the first gasket 102 but also compress the first light-transmitting unit 1014 better. At this time, the first through-hole 1012 of the first pressing plate 1011 are tightly covered with the first light-transmitting unit 1014. but the first gasket 102 is disposed between the first light-transmitting unit 1014 and the front-end plate 1031 of the sleeve.

Preferably, referring to FIG. 11, the first cover unit 101 further includes a first annular structure 1013. At least one end surface of the first pressing plate 1011 is flat, so that the first pressing plate 1011 can be closely attached to the first light-transmitting unit 1014. The first annular structure 1013 is an annular structure. And along the axial direction of the sleeve 103, it is formed by extending the first pressing plate 1011 to one side of the first pressing plate 1011 and protruding from the first pressing plate 1011. The axis of the first annular structure 1013 is parallel to the axis of the first pressure plate 1011, preferably is coincident to each other. Moreover, the axes of the first pressing plate 1011, the first through-hole 1012, the first light-transmitting unit 1014, the first annular structure 1013, the first gasket 102, the first opening and the sleeve 103 are preferably coincident to each other. Wherein, the first pressing plate 1011 and the first annular structure 1013 can be integrally formed, or be connected by other fixed connection methods such as screw connection.

The diameter of the inner peripheral surface of the first annular structure 1013 is equal to or slightly greater than the diameter of the first light-transmitting unit 1014 so that the first light-transmitting unit 1014 is placed in the first annular structure 1013. At the same time, in the unstressed state, the diameter of the outer circumferential surface of the first washer 102 is equal to or slightly greater than the diameter of the inner peripheral surface of the first annular structure 1013. Since the first gasket 102 has certain elasticity, the first gasket 102 can still be embedded in the first annular structure 1013 to achieve interference fitting when the diameter of the outer peripheral surface of the first washer 102 is slightly larger than the diameter of the inner peripheral surface of the first annular structure 1013.

Specifically, along the axial direction of the sleeve 103, the thickness of the first annular structure 1013 is equal to or greater than the sum of the thickness of the first light-transmitting unit 1014 and the thickness of the first gasket 102, or greater than the thickness of the first light-transmitting unit 1014 but smaller than the sum of the thickness of the first light-transmitting unit 1014 and the first gasket 102. The width of the first annular structure 1013 can be specifically set according to actual requirements. With this structure, it is convenient to apply force to the first gasket 102 from the radial and axial directions of the first gasket 102, so that the sealing and waterproof effect is improved.

In some embodiments, referring to FIG. 5, the light source protecting assembly 100 further includes a second gasket 106 and a second pressing plate 105 with a second through-hole 1051. The light source part 201 is attached to one end of the heat sink 202. The second pressing plate 105 abuts against the inner side wall of the sleeve 103, and the second pressing plate 105 presses the second gasket 106 to the end of the heat sink 202. The light emitted by the light source part 201 passes through the second through-hole 1051 of the second pressing plate 105.

The light source part 201 of the light fixture includes a light-emitting element and a substrate. The substrate may be a substrate with high thermal conductivity such as a metal substrate or a ceramic base. The light-emitting element may include multiple independent light-emitting diodes which are arranged in an array to form a single high-brightness light emitting surface. A single or multiple light emitting diode arrays (Light Emitting Diode, LED) can be arranged on the substrate. For example, the light-emitting element may be a Chip on Board (COB) light source. Of course, other types of light-emitting elements, such as organic light-emitting diodes or laser diode arrays, are also feasible.

The light-emitting element can be attached to the first side of the substrate by thermally conductive silicone grease or silica gel, or it is fixed to the first side of the substrate by fasteners such as screws, or the light-emitting element can be fixed to the first side of the substrate in the above two ways. The second side of the substrate is fixed on one side of the heat conducting portion 2023, and one end of the heat conducting pipe 2021 is fixed to the other side of the heat conducting portion 2023. The heat conducting pipe 2021 and the light source part 201 are located on opposite sides of the heat conducting part 2023. The light-emitting element of the light source part 201 is facing the first light-transmitting part of the first cover unit 101 to provide a better lighting effect.

As shown in FIG. 9, the second pressing plate 105, the second gasket 106 and the light source part 201 are all located in the sleeve 103. The second gasket 106 which can be deformed when subjected to an external force is an annular with a hollow central part. The second gasket 106 can be made of silica gel, rubber or other elastic materials, as long as it has a sealing effect and a certain resistance to liquid substances such as water or high temperature conditions. In the following description, taking the cross-sectional shape of the second gasket 106, the cross-sectional shape of the second pressure plate 105, and the cross-sectional shape of the second through-hole 1051 are circular along the plane direction perpendicular to the axis of the sleeve 103 as an example.

The second pressing plate 105 is partially recessed on the outer edge of the substrate of the light source part 201 without light-emitting elements. A second through-hole 1051 penetrating the second pressing plate 105 along its thickness direction is disposed on the second pressing plate 105. The light-emitting element of the light source part 201 is disposed toward the second through hole 1051. The specific structure of the second pressing plate 105 is not limited, as long as it has a second through-hole 1051 to facilitate the light emitted by the light-emitting element to pass through. The second pressing plate 105 presses the second gasket 106 to one end of the heat sink 202. At this time, the light source part 201 and the second gasket 106 are both attached to the same side of the heat conducting portion 2023, and the second gasket 106 surrounds the outer circumference of the light source part 201.

The second through-hole 1051 is preferably a tapered hole. In addition, from the light source part 201 to the direction away from the light source part 201, the second through-hole 1051 of the second pressing plate 105 is inclined toward the side wall of the light source part 201, and the inclined side wall has a certain reflection effect to concentrate light during the working process of the light source part 201. For example, a white reflective layer can be coated on the side wall. Of course, considering the effect of temperature on the coating material, the second pressing plate 105 made of white plastic can be used in practice. At the same time, because of insulating properties of plastic, it can avoid a short circuit or leakage caused by direct contact between the circuit part of the light source part 201 and metal structures.

At this time, an annular metal pressing piece can also be disposed on one side of the second pressing plate 105. The metal pressing piece is located on the side of the second pressing plate 105 away from the heat sink 202. The metal pressing piece and the second pressing plate 105 are screwed to the heat conducting portion 2023 with the fasteners such as screws to press the second pressing plate 105 on the heat conducting portion 2023 more effectively to prevent the second pressing plate 105 from loosening caused by thermal expansion and contraction.

The diameter of the second pressing plate 105 is the same as the inner diameter of the sleeve body 1032, which facilitates the formation of abutment structure between outer peripheral surface of the second pressing plate 105 and the inner wall of the sleeve body 1032 to prevent liquid substances such as water from entering the light source part 201 from the area between the second pressing plate 105 and the sleeve body 1032.

The structure of the second pressing plate 105 and the second gasket 106 that abut the sleeve 103 is provided at the front end of the light source part 201 to provide further protection for the light source part 201 to prevent liquid substances such as water in the housing from flowing into the sleeve 103. The light source part 201 can be protected from the front and rear orientation of the fixture, which can effectively improve the protection effect.

In some embodiments, as shown in FIG. 7 and FIG. 8, the light source protecting assembly 100 further includes an intermediate connecting piece 104. The intermediate connecting piece 104 includes a first annular connecting piece 1041 and a second annular connecting piece 1043, and the second annular connecting piece 1043 is sleeved outside the first annular connecting piece 1041. The inner peripheral surface 1044 of the second annular connecting piece and the outer peripheral surface 1042 of the first annular connecting piece are arranged at a preset angle, and the first end of the first annular connecting piece 1041 is fixedly connected to the first end of the second annular connecting piece 1043. As shown in FIG. 10, the sleeve 103 includes a sleeve body 1032 and a rear end plate 1033 of the sleeve, and the rear end plate 1033 is fixedly connected to the sleeve body 1032 and sleeved on the outer peripheral of the sleeve body 1032. The second end of the second annular connecting piece 1043 is fixedly connected to one end of the housing 400, and the second end of the first annular connecting piece 1041 presses the rear end plate 1033 of the sleeve against the end of the housing 400.

The first annular connecting piece 1041 is usually a hollow cylindrical structure, and the second annular connecting piece 1043 is usually a hollow frustum structure with a regular or irregular shape. The first end of the first annular connecting piece 1041 is fixedly connected to the first end of the second annular connecting piece 1043. The inner peripheral surface 1044 of the second annular connecting piece and the outer peripheral surface 1042 of the first annular connecting piece are in a present angle that can be specifically set according to requirements or actual conditions. The preset angle is usually an acute angle, so that the first annular connecting piece 1041 and the second annular connecting piece 1043 form a structure similar to "∠".

The second end of the second annular connecting piece 1043 is fixedly connected to one end of the housing 400, and the second end of the first annular connecting piece 1041 presses the rear end plate 1033 of the sleeve against the aforementioned end of the housing 400. Specifically, a plurality of screw holes can be distributed along the circumferential direction of the intermediate connecting piece 104, and the intermediate connecting piece 104 is screwed to the aforementioned end of the housing 400 by a plurality of fasteners. With this structure, the second annular connecting piece 1043 is attached to the housing 400 above the position where the rear end plate 1033 of the sleeve and the housing 400 is contacted with to improve the waterproof effect.

The inner peripheral surface of the first annular connecting piece 1041 and the outer peripheral surface of the sleeve body 1032 are spaced at a certain distance. A plurality of through-holes are distributed along the circumference of the rear end plate 1033 of the sleeve. One end of the plurality of telescopic is fixed to the housing 400 and the other end passes through the above-mentioned through-hole and extends toward the front-end of the sleeve 103. A plurality of grooves are disposed on the inner circumference of the first annular connecting piece 1041. The clamping structures of other optical accessories is extruded and retractable along the axial direction of the sleeve 103, so that the clamping structures can be clamped in the grooves of the first annular connecting piece 1041.

Furthermore, at least a part of the rear end plate 1033 of the sleeve protrudes from the outer peripheral surface 1042 of the first annular connecting piece. Specifically, since there is a certain hollow area between the first annular connecting piece 1041 and the second annular connecting piece 1043, when the first annular connecting piece 1041 presses the rear end plate 1033 of the sleeve against one end of the housing 400, a partial structure of the rear end plate 1033 of the sleeve can be contained in the hollow area. That is, the diameter of the outer peripheral surface of the rear end plate 1033 of the sleeve is greater than the diameter of the outer peripheral surface 1042 of the first annular connecting piece. Since the rear end plate 1033 of the sleeve is close to the end of the housing 400, even if the water enters into the area between the second annular connecting piece 1043 and the first annular connecting piece 1041 from the position where the second annular connector 1043 and the end of the housing 400 are connected, water is difficult to flow into the sleeve 103 to further improve the waterproof effect.

In some embodiments, the intermediate connecting piece 104 further includes a second annular structure 1045 and a third annular structure 1047. One end of the second annular structure 1045 is fixedly connected to the second end of the second annular connecting piece 1043, and the other end is fixedly connected to the third annular structure 1047. A fourth annular structure 407 is fixed at one end of the housing 400. The inner peripheral surface 4071 of the fourth annular structure is attached to the outer peripheral surface 1048 of the third annular structure, and the end surface of the fourth annular structure 407 is attached to the second annular structure 1045.

Along a plane direction perpendicular to the axis of the sleeve 103, the cross-sectional shapes of the first annular connecting piece 1041, the second annular connecting piece 1043, the second annular structure 1045, the third annular structure 1047, and the fourth annular structure 1047 can all be circular shape. Wherein, in order to place the light fixture on the ground or other structures more steadily, the bottom of the housing 400 is usually a plane or a plane-like structure. Therefore, the cross-sectional shapes of the second annular connecting piece 1043, the second annular structure 1045, the third annular structure 1047, and the fourth annular structure 1047 are preferably structures with an arc shape at the upper part and a linear shape at the bottom.

Along the axial direction of the sleeve 103, the second annular structure 1045 is located between the second annular connector 1043 and the third annular structure 1047. The distance from any point on the outer peripheral surface 1048 of the third annular structure to the axis of the first annular connecting piece 1041 is smaller than the distance from the corresponding point on the outer peripheral surface 1046 of the second annular structure to the axis of the first annular connecting piece 1041. The second annular structure 1045 and the third annular structure 1047 form a stepped structure, and the second annular connecting piece 1043, the second annular structure 1045 and the third annular structure 1047 may be integrally formed.

When the intermediate connecting piece 104 is connected to the housing 400, the inner peripheral surface 4071 of the fourth annular structure of the housing 400 is at least partially attached to the outer peripheral surface 1048 of the third annular structure, and one end surface of the fourth annular structure 407 is attached to the one end surface of the second annular structure 1045. The intermediate connecting piece 104 adopts a stepped structure to realize the connection with the housing 400, so that part of the structure of the intermediate connecting piece 104 extends to the inside of the housing 400 to further improve the waterproof effect.

In some embodiments, as shown in FIG. 1 and FIG. 2, the housing 400 includes a tail end cover 403 and a housing body with a hollow cavity. One end of the housing body is covered with the tail end cover 403. As shown FIG. 2 and FIG. 12, a slot 404 with a down-facing opening is disposed on one end of the housing body, the tail end cover 403 is fixedly connected to the housing body, and the upper end of the tail end cover 403 is locked in the slot 404.

The housing 400 includes a first cover 401, a second cover 402 and a tail end cover 403. The first cover 401 and the second cover 402 enclose to form the main body part of the housing with a cylindrical structure that is open at both ends and has a hollow channel. One of the end of the cylindrical structure is covered with the tail end cover 403 to form a housing with an opening on one of the end.

Figure 12:
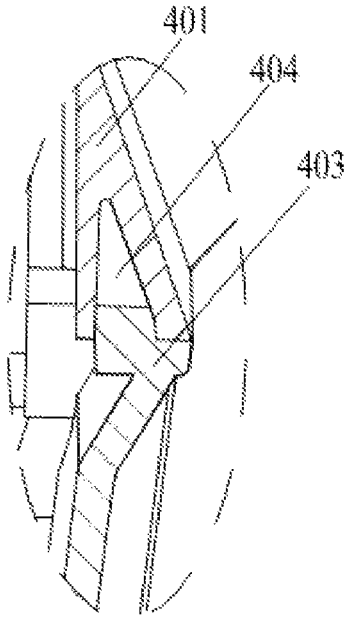
FIG. 12 is a detailed view of position XII of FIG. 2 according to an embodiment of the present disclosure.

Specifically, referring to FIG. 12, a slot 404 is disposed on the rear end of the first cover 401 and the opening of the slot 404 faces downward. In addition, the length direction of the slot 404 and the axis of the sleeve 103 are arranged at a preset angle, and preferably perpendicular. The upper end of the tail end cover 403 is engaged in the above-mentioned slot 404, and its lower end is fixedly connected with the housing body. Specifically, the periphery of the tail end cover 403 is correspondingly in contact with the periphery of the rear-end of the housing body to keep the tail end of housing 400 in a closed state. A third through-hole is disposed on the tail end cover 403 and a tail end cap 4031 can be embedded in the third through-hole for the connection of the power connector.

In addition, the housing 400 includes the first cover 401, the second cover 402 and the tail end cover 403, which not only makes the installation and disassembly methods more convenient but also further improves the waterproof effect and prevents liquid substances such as water from flowing into the inside of the housing 400 through the rear-end of the housing 400.

Figure 13:
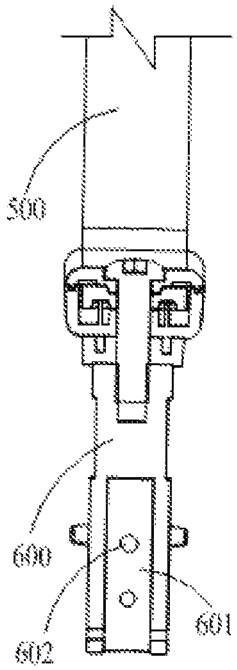
FIG. 13 is a schematic diagram of the structure of a U-shaped bracket and a support rod according to an embodiment of the present disclosure.

It can be understood that, as shown is FIG. 2 and FIG. 13, the light fixture may further include a U-shaped bracket 500 rotatably connected with the housing 400. The setting of the U-shaped bracket 500 is convenient to lift the light fixture. Specifically, the first arm of the U-shaped bracket 500 is rotatably connected to one side of the housing 400 through the first arm end cover, and the second arm is connected to the other side of the housing 400 through the second arm end cover. The U-shaped bracket 500 can be rotated in the vertical direction. Wherein, the way of rotating connection is not specifically limited here.

A support rod 600 is also disposed at the bottom of the U-shaped support 500, and the protruding direction of the support rod 600 relative to the bottom of the U-shaped support 500 is substantially opposite to the protruding direction of any arm relative to the bottom of the U-shaped support 500. The support rod 600 of the support arm has a hollow insertion channel 601, and the axis of the insertion channel 601 and the axis of the support rod 600 preferably coincide with each other. In addition, the support rod 600 is further provided with a fourth through-hole 602, the axis of the fourth through-hole 602 is perpendicular to the axis of the aforementioned insertion channel 601, and the fourth through-hole 602 is connected with the insertion channel 601. Internal threads are arranged on the inner wall of the fourth through-hole 602, and fasteners (such as screws, etc.) can be screwed into the fourth through-hole 602. When a hanger is inserted into the insertion channel 601 of the support rod 600, a screw can be screwed into the fourth through-hole 602, and the hanger is pressed into the insertion channel 601 by the side of the hanger. It is understandable that the light fixtures can also include conventional accessories of other lamps, which will not be listed here.

In the light fixture the present disclosure, a heat sink is disposed in the housing, and a first ventilation region and a second ventilation region are disposed on the housing. The gap between any two adjacent fins is connected with the first ventilation region 405 and the second ventilation that will not only achieve the purpose of heat dissipation, but also can form a channel for fluid circulation. Meanwhile, the blocking mechanism separates the hollow cavity of the housing into a first cavity and a second cavity, and the first cavity and the second cavity are isolated from each other to prevent fluids such as water outside the lamp from entering the second cavity and causing damage to the devices or structures contained in the second cavity.

The light source part is accommodated in the hollow cavity of the light source protecting assembly, and the circuit board is accommodated in the second cavity to effectively protect the light source part and the circuit board. A structure in which the first fin matched with a groove provided on the inner side wall of the casing, or the first fin matched with a second rib fixed on the inner side wall of the housing, or the third rib matched with the groove disposed on the inner side wall of the housing, or the third rib matched with the fourth rib fixed on the inner side wall of the housing is used to form a third cavity connected with the hollow cavity of the light source protecting assembly, which can effectively prevent the fluid from flowing into the second cavity and the third cavity, and is convenient for the installation and removal of devices in the housing.

The light source part is sleeved inside the sleeve. The structure in which the first cover unit presses the first gasket to the front-end of the sleeve can effectively prevent liquid substances such as water from entering the sleeve, thereby preventing the liquid substances from damaging the light source part in the sleeve. Furthermore, the structure of the second pressing plate with the second through hole and the second gasket is adopted to realize that the second pressure plate abuts against the inner side wall of the sleeve and presses the second gasket to the substrate to prevent fluids such as water from being discharged from the housing and further enhance the protection of the light-emitting parts. In addition, a structure in which the end of the tail part is engaged in the slot on the main body of the outer cover to prevent liquid substances such as water from entering the outer cover from the tail part of the outer cover.

In specific implementation, each of the above units or structures can be implemented as independent entities, or in any combination, and implemented as the same or several entities. For the specific implementation of each of the above units or structures, please refer to the previous method embodiments. No longer.

For the specific implementation of each of the above operations, please refer to the previous embodiment, which will not be repeated here.

While the present disclosure has been described with the embodiments, it is preferable that the above embodiments should not be construed as limiting of the present disclosure. On the contrary, the present disclosure includes all the modifications and variations without departing from the spirit and scope of the present disclosure.

What is claimed is:

1. A light fixture, comprising:

a housing with a hollow inner cavity, wherein a first ventilation region and a second ventilation region are arranged on the housing;

a heat sink disposed in the hollow inner cavity of the housing, wherein the heat sink includes a plurality of fins disposed side-by-side corresponding to the first ventilation region and the second ventilation region;

a blocking mechanism disposed between the heat sink and an inner wall of the housing to divide the hollow inner cavity into a first cavity and a second cavity, wherein the plurality of fins are disposed in the first cavity, the first cavity and the second cavity are isolated from each other; wherein a gap is formed between any two adjacent fins, and the first ventilation region, the gap and the second ventilation region are in communication to form a channel; and a fan as an air-cooling structure fixed in the housing, wherein the fan is disposed between the heat sink and the second ventilation region, and an air outlet surface of the fan faces one side of the heat sink.

2. The light fixture as claimed in claim 1, wherein the first ventilation region, the heat sink and the second ventilation region are arranged in a first direction, the first cavity and the second cavity are isolated by the blocking mechanism in a second direction, and the first direction and the second direction intersect on the same plane.

3. The light fixture as claimed in claim 1, further comprising:

a light source protecting assembly which has a hollow cavity, wherein the light source protecting assembly is fixedly attached to the housing;

a light source part thermally connected to the heat sink, wherein the light source part is disposed in the hollow cavity of the light source protecting assembly; and a circuit board electrically connected to the light source part, and the circuit board is disposed in the second cavity.

4. The light fixture as claimed in claim 3, wherein the blocking mechanism comprises a first rib disposed in the housing, a groove is disposed on an inner side wall of the housing, at least the upper outer peripheral portion of the first rib is engaged in the groove, the first rib and the inner wall of the housing enclose to form the second cavity, the first ventilation region and the second ventilation region are located outside the second cavity, and the circuit board is thermally connected to the heat sink and disposed in the second cavity.

5. The light fixture as claimed in claim 3, wherein the blocking mechanism comprises a first rib disposed in the housing and a second rib fixed to an inner side wall of the housing, the second rib at least extends from a top of the inner side wall of the housing to the hollow inner cavity of the housing, the second rib is closed to the first rib and at least partly overlap with each other, wherein the first rib, the second rib and the inner wall of the housing encloses to form the second cavity, the first ventilation region and the second ventilation region are located outside the second cavity, and the circuit board is thermally connected to the heat sink and disposed in the second cavity.

6. The light fixture as claimed in claim 3, wherein the blocking mechanism comprises a third rib disposed in the housing, at least an upper outer peripheral portion of the third rib sealingly mate with the housing, the third rib and the inner wall of the housing encloses to form a third cavity, the first ventilation region and the second ventilation region are located outside the third cavity, and wherein the third cavity is communicating with the hollow cavity of the light source protecting assembly.

7. The light fixture as claimed in claim 3, wherein the light source protecting assembly comprises a sleeve with a hollow cavity, a first gasket, and a first cover unit with a first light-transmitting part; wherein the light source part is sleeved in the hollow cavity of the sleeve, the first cover unit presses the first gasket onto one end of the sleeve, and wherein the first cover unit is fixed on the sleeve, an other end of the sleeve is fixedly attached to the housing.

8. The light fixture as claimed in claim 7, wherein the first cover unit comprises a first light-transmitting unit, a first annular structure, and a first pressing plate with a first through-hole;

wherein one end of the first annular structure is fixedly attached to the first pressing plate, and the first light-transmitting unit is covered with the first through-hole of the first pressing plate, the first light-transmitting unit and the first gasket are embedded in the first annular structure, and wherein the first light-transmitting unit is compressed on one end of the first gasket and an other end of the first gasket abuts the end of the sleeve.

9. The light fixture as claimed in claim 7, wherein the light source protecting assembly further comprises a second gasket and a second pressing plate with a second through-hole;

wherein the light source part is attached to one end of the heat sink, the second pressing plate abuts an inner side wall of the sleeve, and the second gasket is pressed against the end of the heat sink by the second pressing plate, and the light emitted by the light source part shone through the second through-hole of the second pressure plate.

10. The light fixture as claimed in claim 7, wherein the light source protecting assembly further comprises an intermediate connecting piece which includes a first annular connecting piece and a second annular connecting piece, and the first annular connecting piece is arranged in an hollow part of the second annular connecting piece, a first end of the first annular connecting piece is fixedly attached to the first end of the second annular connecting piece, an inner peripheral surface of the second annular connecting piece and an outer peripheral surface of the first annular connecting piece are arranged at a preset angle;

wherein the sleeve includes a sleeve body and a rare end plate of the sleeve that fixedly attached to the sleeve body and is sleeved on an outer peripheral portion of the sleeve body; wherein the second annular connecting piece is fixedly attached to one end of the housing, and wherein the rare end plate of the sleeve is pressed against the end of the housing by an second end of the first annular connecting piece.

11. The light fixture as claimed in claim 10, wherein the intermediate connecting piece further comprises a second annular structure and a third annular structure; wherein one end of the second annular structure is fixedly attached to the second annular connecting piece and an other end is fixedly attached to the third annular structure; and wherein a fourth annular structure is fixed to one end of the housing and the inner circumference of the fourth annular structure abuts an outer peripheral surface of the third annular structure, and an end surface of the fourth annular structure abuts the end surface of the second annular structure.

12. The light fixture as claimed in claim 1, wherein the housing comprises a tail end cover and a housing body with the hollow inner cavity; the tail end cover is covered with one end of the housing body;

wherein a slot with an opening facing downward is disposed on an top end of the housing body and the housing body is fixedly attached to the tail end cover, and an upper end of the tail end cover is engaged in the slot.

* * * * *